US010526796B1

(12) United States Patent
Way

(10) Patent No.: US 10,526,796 B1
(45) Date of Patent: Jan. 7, 2020

(54) DECK SYSTEMS AND RELATED METHODS

(71) Applicant: Crescent Equipment Company, Crescent, GA (US)

(72) Inventor: Robert L. Way, Townsend, GA (US)

( * ) Notice: Subject to any disclaimer, the term of this patent is extended or adjusted under 35 U.S.C. 154(b) by 0 days.

(21) Appl. No.: 15/992,669

(22) Filed: May 30, 2018

Related U.S. Application Data

(60) Provisional application No. 62/524,841, filed on Jun. 26, 2017.

(51) Int. Cl.

| | |
|---|---|
| ***E04F 15/02*** | (2006.01) |
| ***E04F 19/04*** | (2006.01) |
| ***E02B 3/06*** | (2006.01) |
| ***B63B 35/34*** | (2006.01) |

(52) U.S. Cl.
CPC ..... *E04F 15/02183* (2013.01); *B63B 35/34* (2013.01); *E02B 3/064* (2013.01); *E04F 19/04* (2013.01); *E04F 2015/02088* (2013.01); *E04F 2019/0409* (2013.01)

(58) Field of Classification Search
CPC ... E04F 15/02; E04F 15/183; E04F 15/02044; E04F 19/04; E04F 2015/02088; E04F 2019/0409; E04F 13/0819; E04F 2201/05; E04F 15/04; B63B 35/34; E04B 5/02; E01D 19/10; E01D 19/02; E01D 19/00
USPC ..... 52/716.1, 716.7, 716.8
See application file for complete search history.

(56) References Cited

U.S. PATENT DOCUMENTS 3,914,913 A * 10/1975 Roberts ..... E01C 13/04 52/475.1
4,077,334 A * 3/1978 Svirklys ..... B65D 19/0095 108/56.1
4,622,792 A * 11/1986 Betts ..... E04B 5/12 52/263
5,394,667 A * 3/1995 Nystrom ..... E01D 19/125 52/263
5,617,689 A * 4/1997 Beane ..... E04O 3/06 52/177
5,623,803 A * 4/1997 Willis ..... E04F 15/02183 52/403.1
6,651,398 B2 * 11/2003 Gregori ..... E04B 5/02 182/222
6,695,541 B1 * 2/2004 Spence ..... E02B 3/068 114/263

(Continued)

FOREIGN PATENT DOCUMENTS

DE 202012104056 U1 * 1/2014 ..... E04C 3/28
DE 202013010345 U1 * 1/2014 ..... E04F 15/02044

(Continued)

*Primary Examiner* — Beth A Stephan
(74) *Attorney, Agent, or Firm* — Allen Dyer Doppelt & Gilchrist, PA

(57) ABSTRACT

A deck board supporting system includes a plurality of interconnected skirt joists configured as an outer perimeter of the deck board supporting system and a plurality of deck joists configured to be attached to one or more of the plurality of skirt joists within the outer perimeter. Each of the skirt joist and deck joist has a respective longitudinal groove formed on a respective top surface, and the longitudinal groove extends downwards perpendicular to the respective top surface. The longitudinal groove is configured for receiving one or more fasteners for connecting one or more deck boards to the top surfaces of the respective skirt joists and deck joists.

18 Claims, 13 Drawing Sheets

(56) References Cited

U.S. PATENT DOCUMENTS 6,871,467 B2 * 3/2005 Hafner ..... E04B 5/12 52/480
8,146,303 B2 * 4/2012 Gibson ..... E04B 5/12 52/177
8,256,172 B2 * 9/2012 Benson ..... E04F 11/035 52/126.1
8,522,505 B2 * 9/2013 Beach ..... E04B 5/023 403/286
9,057,190 B1 * 6/2015 Winter ..... E04F 15/02044
10,145,122 B2 * 12/2018 Rodriguez Lopez ..... E04F 13/0812
2004/0045244 A1 * 3/2004 Hafner ..... E04B 5/12 52/489.1
2006/0283122 A1 * 12/2006 Burgess ..... E04B 5/12 52/480
2010/0186338 A1 * 7/2010 Rischmueller ..... E01C 15/00 52/650.3
2014/0096469 A1 * 4/2014 Fountain ..... E04F 15/02044 52/650.3
2014/0215944 A1 * 8/2014 Husler ..... E04F 15/02044 52/302.1
2014/0318065 A1 * 10/2014 Torres-Pinzon ..... E04F 15/02044 52/403.1
2015/0128519 A1 * 5/2015 Weber ..... E04F 15/02038 52/489.1
2017/0044776 A1 * 2/2017 Rodriguez Lopez ..... E04F 13/0826
2017/0254077 A1 * 9/2017 Andres ..... E04F 15/02044

FOREIGN PATENT DOCUMENTS

EP 2275613 A2 * 1/2011 ..... E04F 15/02
EP 2664731 A1 * 11/2013 ..... E04F 15/02183
WO WO-2011149371 A1 * 12/2011 ..... E04F 13/0826
WO WO-2015174835 A1 * 11/2015 ..... E04F 15/02183

* cited by examiner

DECK SYSTEMS AND RELATED METHODS

CROSS-REFERENCE TO RELATED APPLICATION

The present application claims the benefit of U.S. Provisional Patent Application Ser. No. 62/524,841, filed on Jun. 26, 2017, the contents of which are herein incorporated by reference in their entirety.

FIELD OF THE INVENTION

The present invention relates to a deck system, and more particularly, to a deck board supporting system without predrilled holes in home deck, floating dock and pier constructions.

BACKGROUND OF THE INVENTION

A typical process of attaching a deck board to aluminum joists involves pre-drilling holes through one or more deck boards into one or more aluminum joists and securing fasteners in the predrilled holes. This approach, though useful, has some disadvantages. For example, seasonal movement of the deck board during cycles of heat and cold can increase the tendency of fasteners to fail in shear. In coastal areas, galvanic reactivity between a stainless fastener and an aluminum joist can cause a fastener to corrode. A corroded fastener can no longer be retracted, because it will break at the weakened connection point. Shear failure can be forestalled by a timber or other non-metallic batten, but this will add cost and time. Moreover, holes with broken fasteners cannot be reused. Instead, after removing the broken fastener and smoothing the joist surface, another hole must be drilled adjacent to the original, potentially creating a cosmetic flaw in the deck board. Furthermore, the size of the pre-drilled hole is critical. If the hole is too small, it will break the fastener or destroy its head, whereas if the hole is too large, it will lead to reduced grip force on the fastener. Pre-drilling also adds time to the process and may yield unpredictable results. For such reasons and others, further improvements in deck fixing are possible.

SUMMARY OF THE INVENTION

In view of the foregoing, it is an object of the present invention to provide improved method of attaching decks. According to one embodiment of the present invention, a deck board supporting system includes a plurality of interconnected skirt joists configured as an outer perimeter of the deck board supporting system and a plurality of deck joists configured to be attached to one or more of the plurality of skirt joists within the outer perimeter. Each of the skirt joist and deck joist has a respective longitudinal groove formed on a respective top surface, and the longitudinal groove extends downwards perpendicular to the respective top surface. The longitudinal groove is configured for receiving one or more fasteners for connecting one or more deck boards to the top surfaces of the respective skirt joists and deck joists.

According to another embodiment of the present invention, a method of installing a deck system includes interconnecting a plurality of skirt joists to form an outer perimeter of the deck board supporting system and attaching a plurality of deck joists to the plurality of skirt joists within the outer perimeter of the deck board supporting system. The plurality of deck joists are further secured to respective vertical posts. A plurality of deck boards are placed on top surfaces of the interconnected skirt joists and the plurality of deck joists. the plurality of deck boards are secured to the deck board supporting system via positioning one or more fasteners into respective grooves on the top surfaces of the plurality of skirt joists and the plurality of deck joists.

These and other objects, aspects and advantages of the present invention will be better appreciated in view of the drawings and following detailed description of preferred embodiments.

DETAILED DESCRIPTION OF PREFERRED EMBODIMENTS

Referring to FIGS. 1-4, a deck board supporting system 10 includes a plurality of interconnected skirt joists 12 configured as an outer perimeter of the deck board supporting system 10 and a plurality of deck joists 14 configured be attached to one or more of the plurality of skirt joists within the outer perimeter. A plurality of deck boards 16 are securely positioned on the deck board supporting system 10. As such, a plurality of skirt joists 12 are perimeter joists, and serve as the outer perimeter of the supporting system 10. A plurality of deck joists 14 are positioned inside the perimeter, forming an inner part of the supporting system 10. In the depicted embodiment, a plurality of skirt joists 12 are shown form a right-angle corner of an outer perimeter and a plurality of deck joists 14 within the outer perimeter are stacked and/or connected to form an inner portion of the supporting system 10. The inner portion and outer premier of the supporting system 10 together are configured to support a plurality of deck boards 16 placed thereon.

Figure 1:
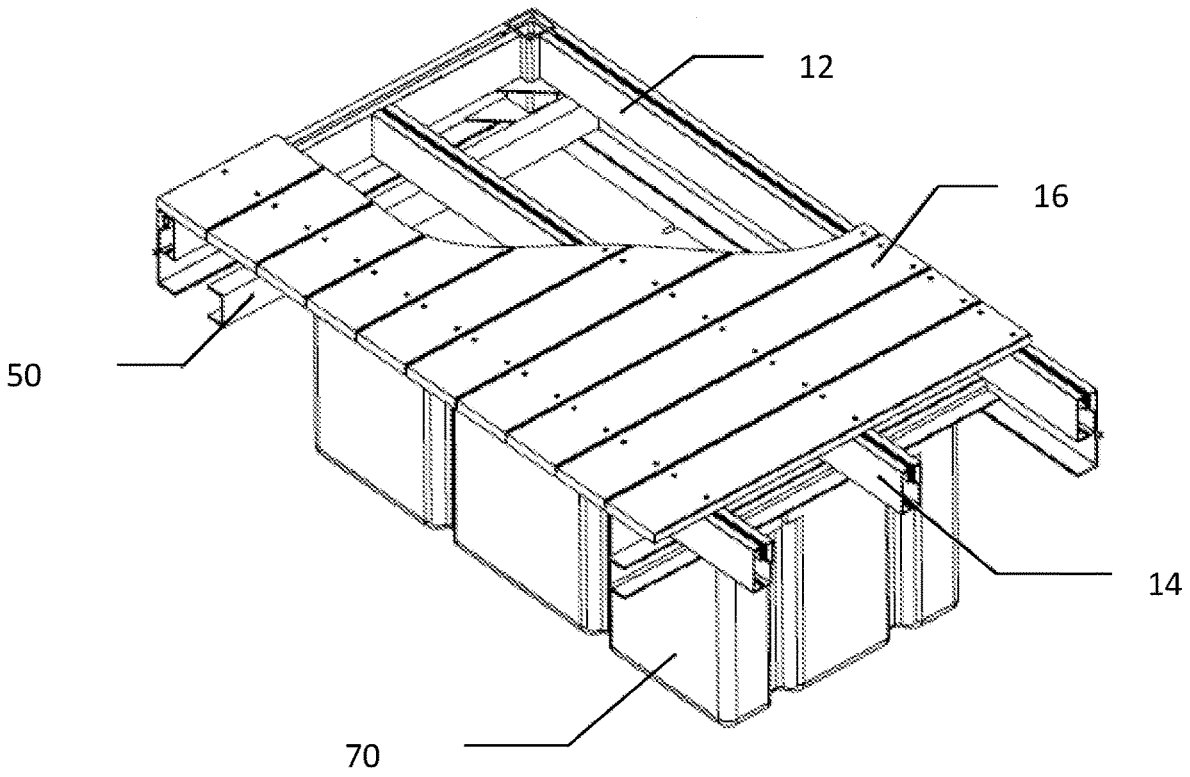
FIG. 1 is a perspective view of an improved deck system, according to one embodiment of the present invention.
Figure 2:
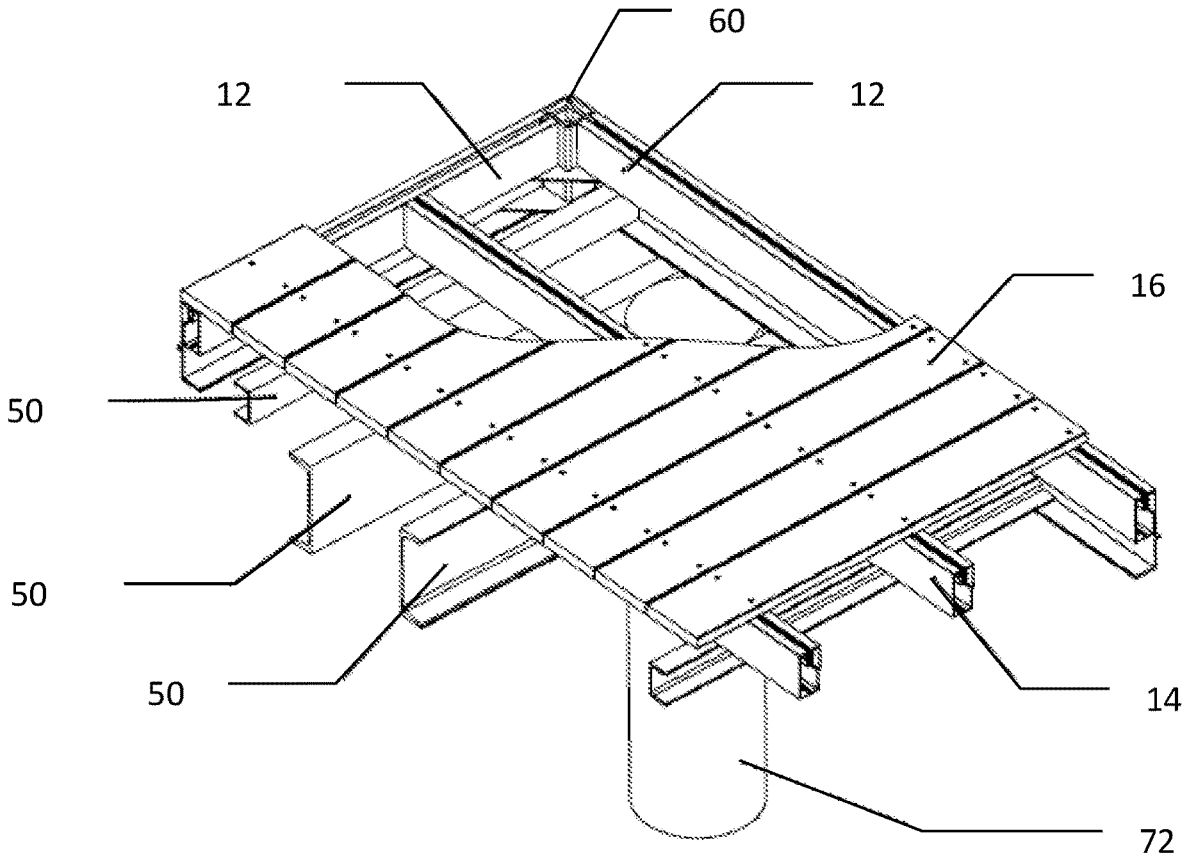
FIG. 2 is a perspective view of an improved deck system, according to another embodiment of the present invention.

In the embodiment depicted in FIGS. 1 and 2, a plurality of cross members 50 are positioned between parallel skirt joists 12 of the outer perimeter and underneath and perpendicular to the plurality of deck joists 14. The plurality of cross members 50 can be further supported by a flotation device 70 as shown in FIG. 1 or a fixed support 72, as shown in FIG. 2. FIGS. 1-2 also show a corner member 60 used in corner connections of the outer perimeter between two perpendicular positioned joist skirts 12.

Figure 3:
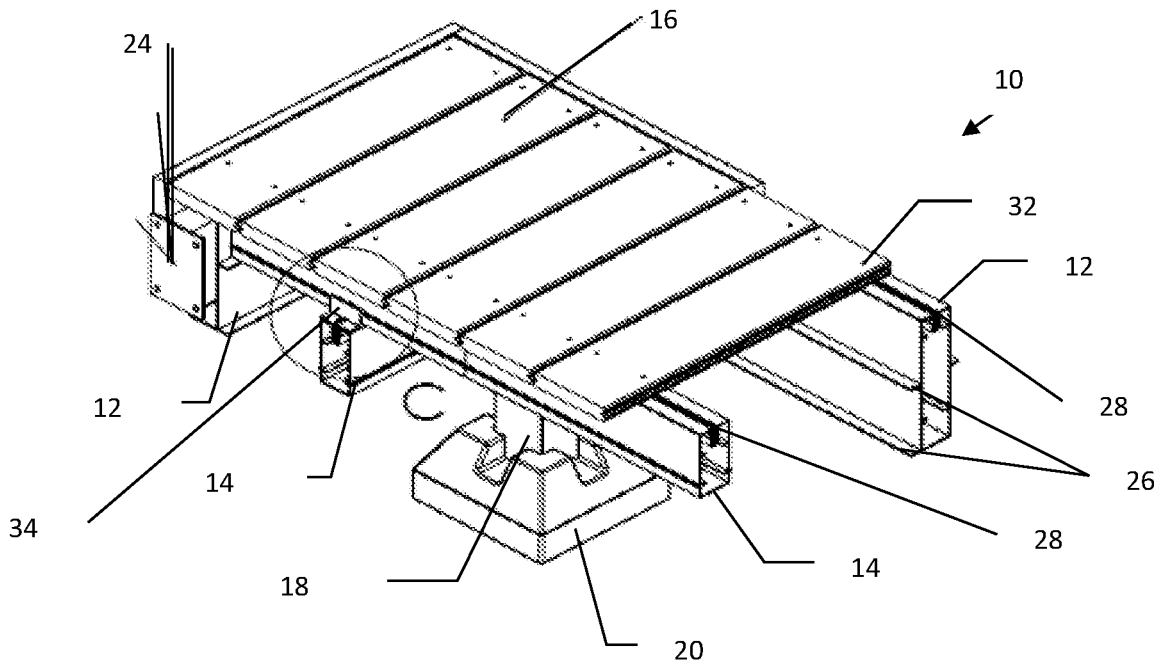
FIG. 3 is a perspective view of an improved deck system, according to another embodiment of the present invention.
Figure 4:
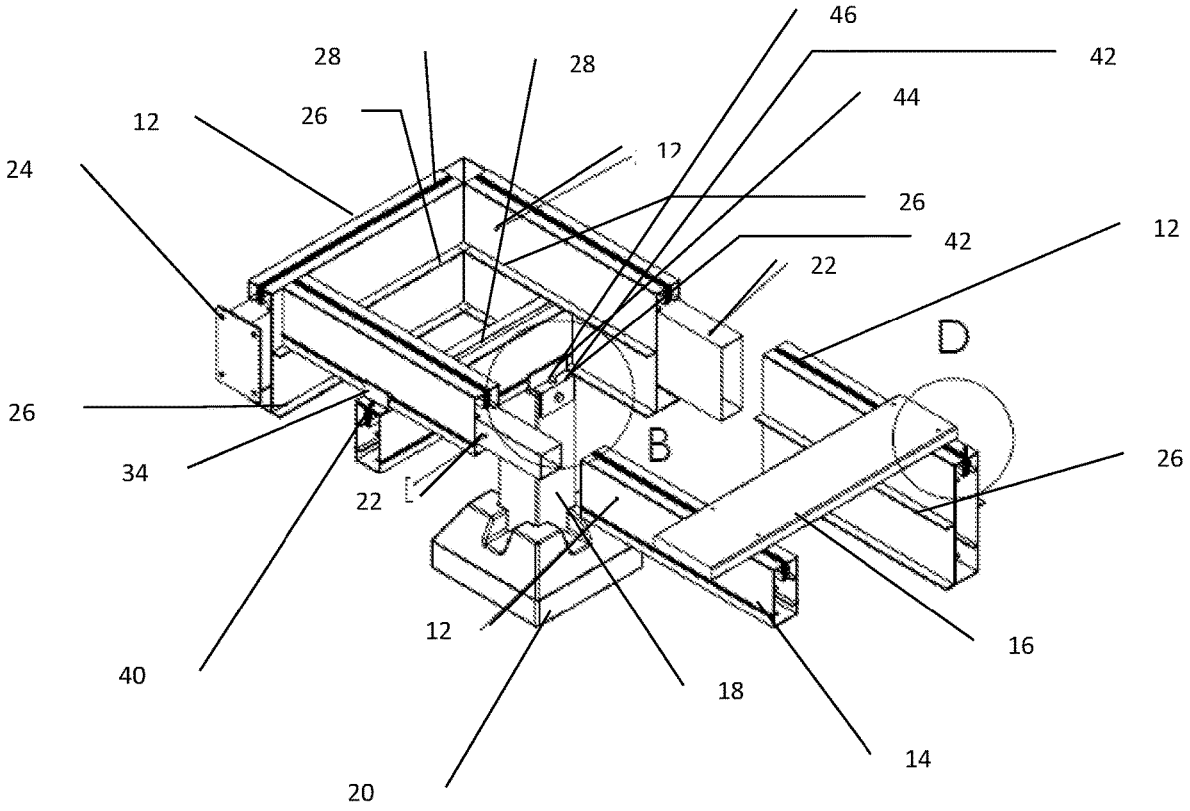
FIG. 4 is an exploded view of the improved deck system of FIG. 3.

In the embodiment depicted in FIGS. 3 and 4, no cross members 50 are used. Instead, the cross members 50 of FIGS. 1 and 2 are replaced by a plurality of deck joists 14. FIGS. 3 and 4 show a plurality of deck joists 14 are further supported by a fixed support such as a vertical post 18 situated on a base 20. This can further elevate the height of a deck system. As an example, the vertical post 18 can be made from a pressure treated wood or other polymer material that has high strength and is highly endurable. The base 20 can be cast in concrete and secured to an underlying surface (e.g., ground). This is a type of fixed support.

Figure 5:
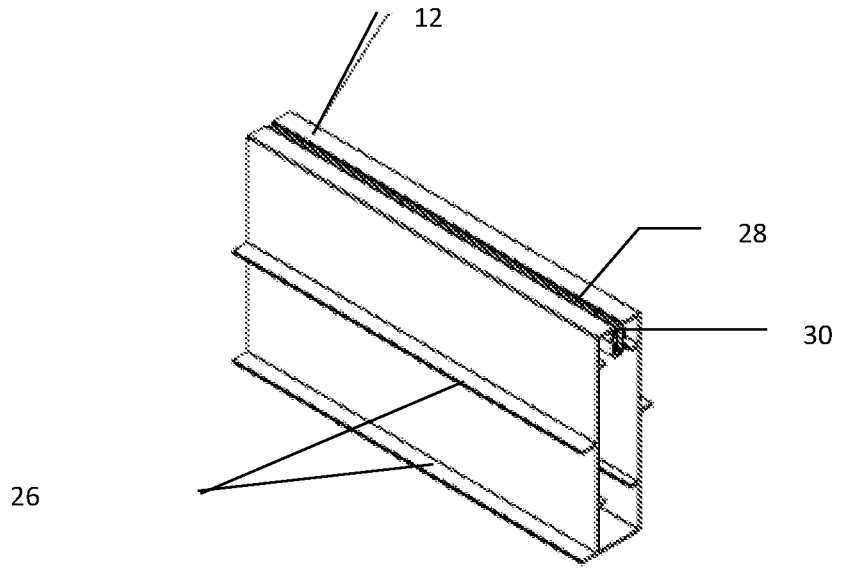
FIG. 5 is a perspective view of a skirt joist of the improved deck system of FIG. 1, according to another embodiment of the present invention.
Figure 6:
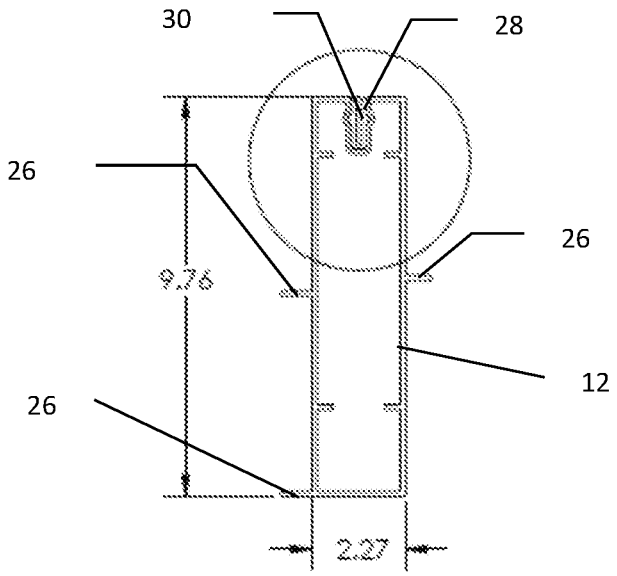
FIG. 6 is an end view of the skirt joist of FIG. 5.
Figure 7:
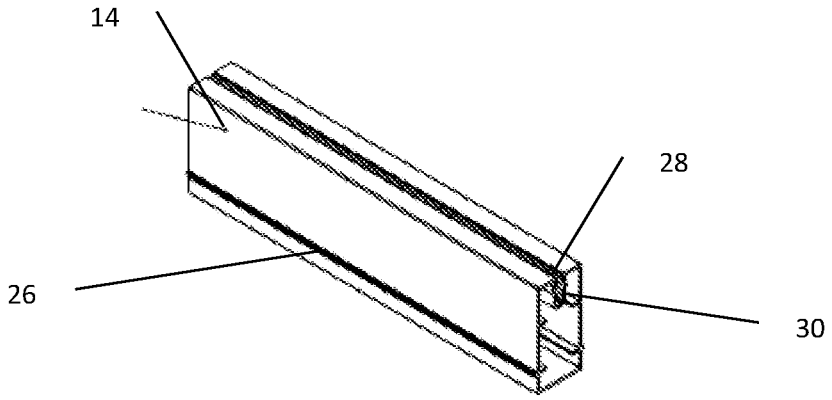
FIG. 7 is a perspective view of a deck joist of the improved deck system, according to one embodiment of the present invention.
Figure 8:
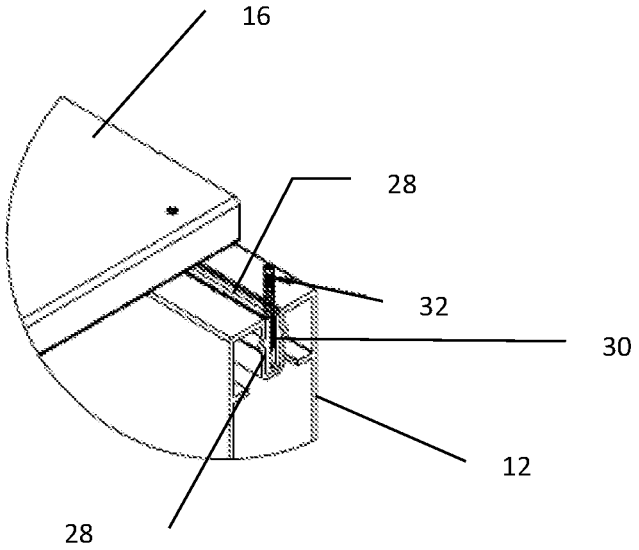
FIG. 8 is a detailed view of section D of FIG. 4.

Referring to FIGS. 5 and 6, each joist (skirt joists 12 and the deck joists 14) is an elongated structural member having a first end and a second end defining a length. The joists (e.g., skirt joist 12 and deck joist 14) have a standard dimension (e.g., length, height, width), as such, multiple joists (skirt joist or deck joist) can be interconnected and/or stacked together to achieve a desired deck system dimension.

Each joist can include a hollow tubular portion at the first end and the second end. For example, a splice member 22, as illustrated in FIG. 4, is sized and shaped to be received snugly within the hollow tubular portion at the first and second ends of the corresponding joist. One or more skirt joists 12 or deck joists 14 can be connected via respective splice members 22 to span a desired length. A hollow tubular portion at the ends of a joist (e.g., skirt joist) can be covered by a wall flange 24. The joists (skirt joist 12 and deck joists 14) are preferably made of aluminum or other suitable metals.

Referring to FIGS. 3-6, the height of the skirt joists 12 can be twice that of the deck joists 14; two deck joists 14 stacked together perpendicularly to achieve a same height as that of a skirt joist 12. The decking boards 16 can thus be leveled on top of the supporting system 10. In the depicted embodiment, one or more ledges 26 are formed on at least one outer surface of a skirt joist 12 to engage with a deck joist 14 positioned perpendicular to the skirt joist 12.

Each joist (skirt joist and deck joist) has a longitudinal groove 28 formed on its top surface. The longitudinal groove extends perpendicular to the respective top surface. A plastic insert 30 is fitted inside each groove 28 for receiving fasteners for connecting a deck board 16 onto a deck joist 14 or a skirt joist 12. The plastic insert 30 is depicted as a U-shaped plastic insert. For example, when connecting a deck board 16 to a skirt joist 12, one or more fasteners 32 can be extended downward through deck boards 16 into the U-shaped plastic insert 30 inside the groove 28 on a skirt joist 12 and/or a deck joist 14, thereby fixing the deck boards 16 to the respective skirt joist 12 as shown in FIGS. 1-3 and 8. The plastic insert 30 is preferably rendered from polyvinylchloride (PVC), but any suitable thermoplastic material such as polypropylene, polyethylene, high density polyethylene (HDPE), vinyl acetate copolymers, vinyl chloride monomers (VCM), or acrylonitrile-butadiene-styrene (ABS) can be used.

Figure 9:
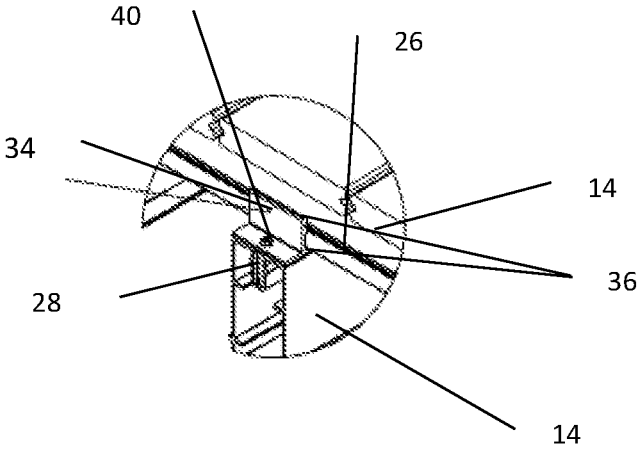
FIG. 9 is a detailed view of section C of FIG. 3.

According to another embodiment of the present invention, two perpendicularly positioned joists (e.g., two perpendicularly positioned deck joists) are securely connected by an L-shaped joist clip 34 (shown in FIGS. 4 and 9). Specifically, one plane of the L-shaped joist clip 34 has a pair of flanges 36 configured to snap over a ledge 26 extending from an outer surface of an upper deck joist and a bottom surface of a deck joist 14 respectively. Another plane of the L-shaped joist clip 34 includes an opening configured to align with a groove on a top surface of a lower deck joist. A fastener 40 (e.g., a screw) can be inserted through the opening on the joist clip 34 into the groove 28 of the lower deck joist 14.

Figure 10:
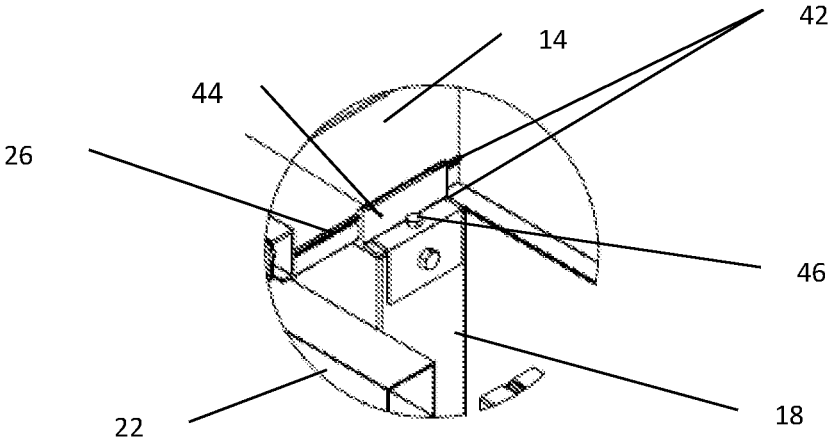
FIG. 10 is a detailed view of section B of FIG. 4.
Figure 11:
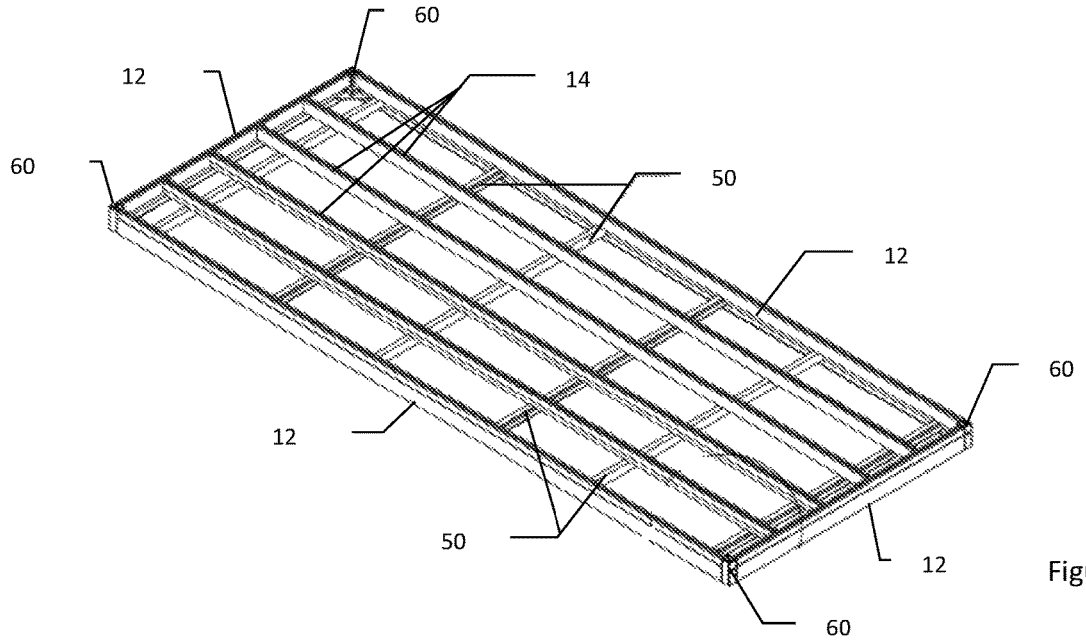
FIG. 11 is a perspective view of a deck supporting system of FIG. 1.
Figure 12:
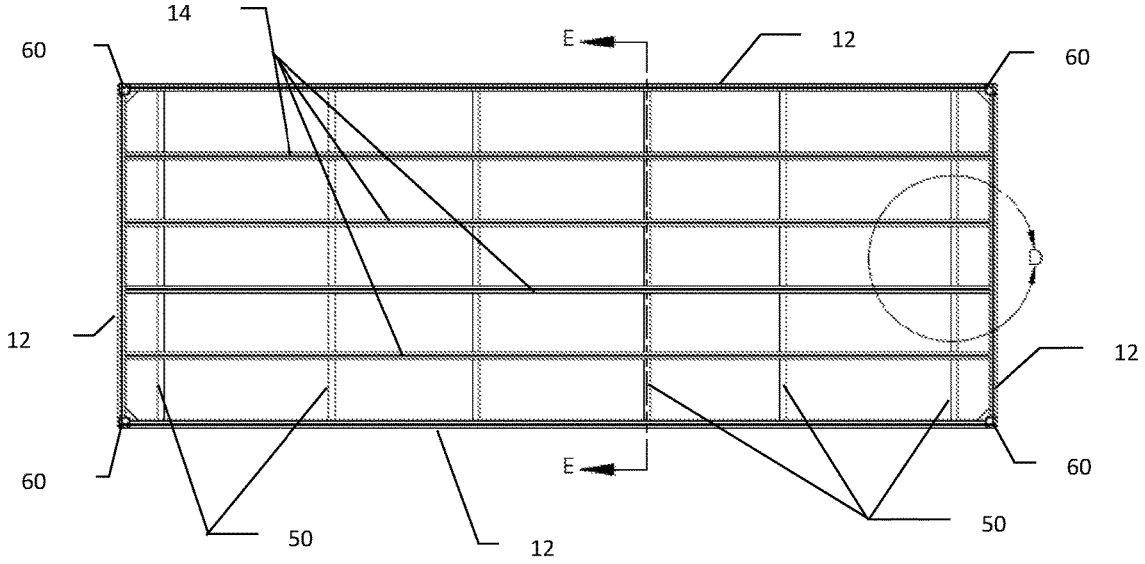
FIG. 12 is a top view of the deck supporting system of FIG. 11.
Figure 13:
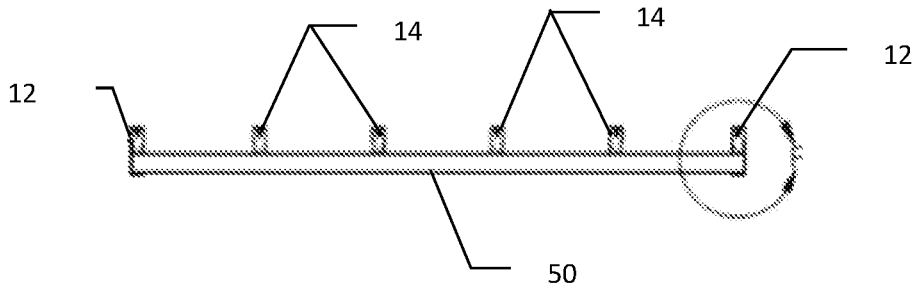
FIG. 13 is a cross sectional view of the deck supporting system along line E-E' of FIG. 12.

According to another embodiment of the present invention, a post clip 42 (shown in FIG. 10) can be used to connect a deck joist 14 to a vertical post 18. The post clip 42 can have a similar structure profile as the joist clip 34 but different dimensions for their respective purposes. Specifically, a pair of flanges 44 on one plane of the L-shaped post clip 42 are snapped over a ledge 26 on an outer surface and bottom surface of a deck joist 14 respectively, and another plane of the L-shaped post clip 42 is positioned on a top surface of the vertical post 18. One or more fasteners 46 can secure the post clip 42 into the vertical post 18.

The disclosed no-drill deck system 10 can prevent galvanic corrosion because the plastic insert 30 acts as a dielectric between the fastener and the aluminum. Fasteners will thus not corrode and be able to last for many years without degradation of the joists, fasteners or deck boards. A fastener captivated within a plastic extrusion will allow for expansion/contraction within a metal (e.g., aluminum) joist without sacrificing grip force. The no-drill deck attachment system does not require a timber batten as the fastener will not subject to the shear forces created by expansion and contraction of the deck boards.

The components (e.g., skirt joist 12, deck joist 14, plastic insert 30, joist clip 34, post clip 42) of the deck supporting system 10 can be packaged into a standard kit and delivered in a box. The standard and unified dimensions of the skirt joist 12 and deck joist 14 can also be easy and low cost to manufacture.

FIGS. 11-16 illustrate a detailed view of the embodiment using cross members 50. A plurality of cross members 50 are positioned between parallel skirt joists 12 of the outer perimeter and underneath and perpendicular to the plurality of deck joists 14. The plurality of cross members 50 can be further supported by flotation device 70, as depicted in FIG. 1.

Figure 14:
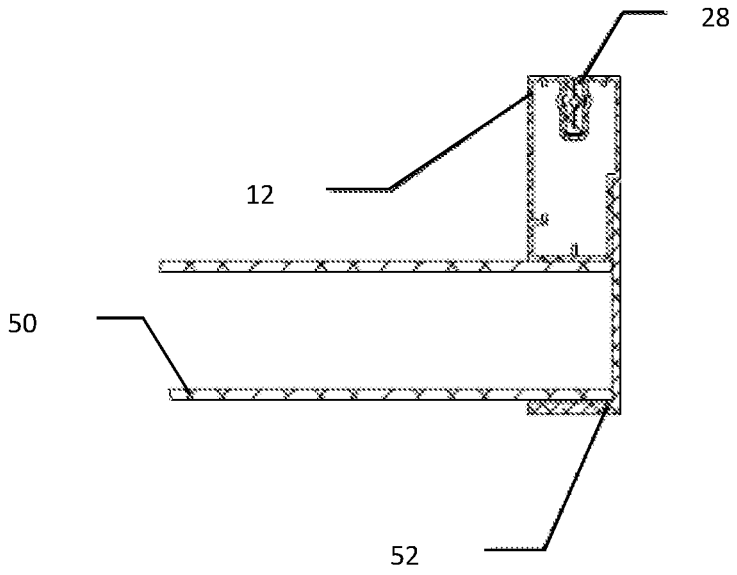
FIG. 14 is a detailed view of the area F of FIG. 13.
Figure 15:
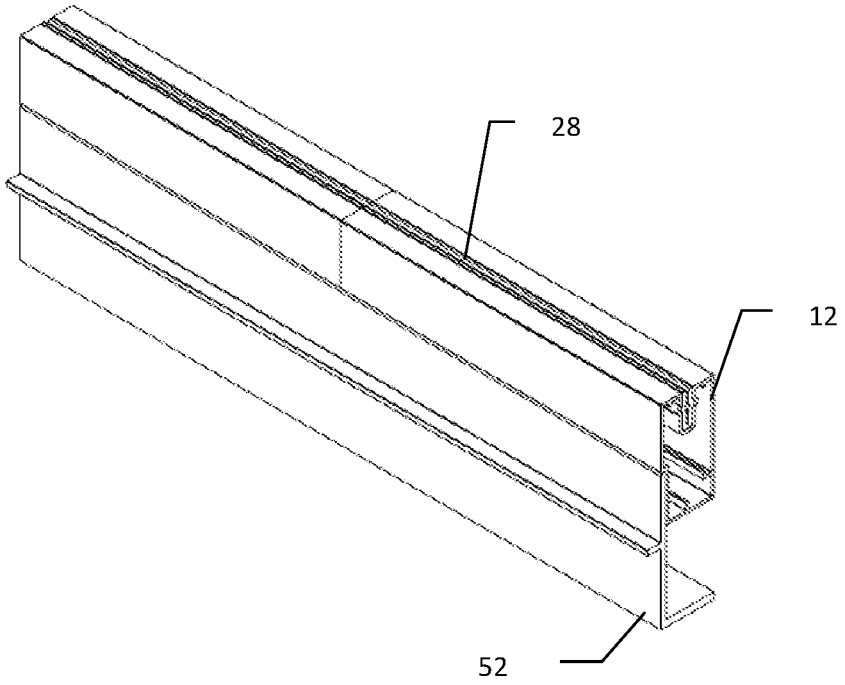
FIG. 15 is a perspective view of a L-shaped mounting bracket connected to a skirt joist.

FIGS. 14 and 15 illustrate an example of an aluminum joist assembly including an L-shaped mounting bracket 52 welded to an indented face of an extruded deck joist 12 to form an integral piece. Specifically, the L-shaped mounting bracket 52 and the deck joist 12 are designed to form a pocket and ledger for the cross member 50. The L-shaped bracket 52 can be formed from sheet material or be an extruded shape (e.g., aluminum) having two flat plate portions which are perpendicular to each other and meet at a juncture line. A first flat plate portion of the L-shaped mounting bracket 52 is designed to supplement to the outer surface of the respective skirt joist 12 and a second flat plate portion of the L-shaped mounting bracket 52 is positioned to hold the bottom surface of the respective cross member 50 such that the juncture line is fitted to an outer bottom edge of the cross member 50.

Figure 16:
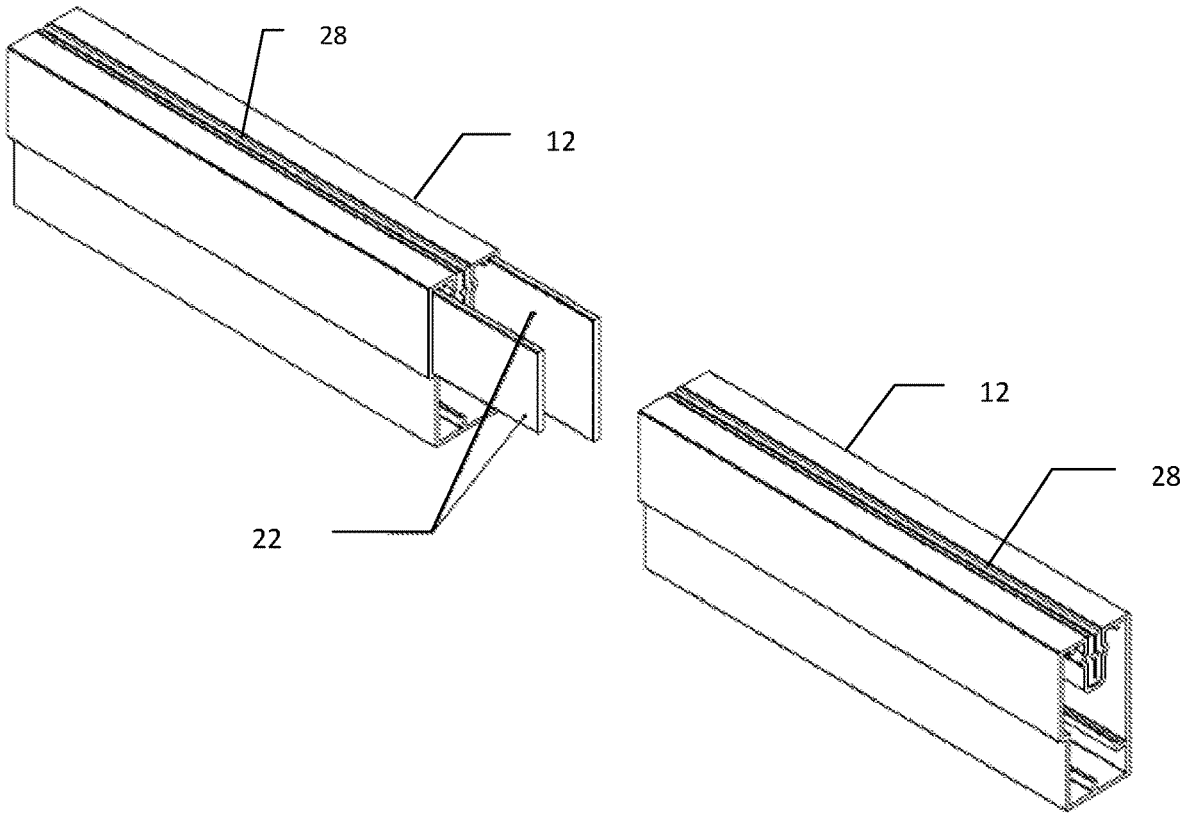
FIG. 16 is a perspective view of two deck joists of FIG. 14 connected via splice members.

FIG. 16 illustrates two skirt joists connected by splice members 22 sized and shaped to be received within the hollow tubular portion at the first and second ends of the corresponding joist and parallel with side surfaces of the skirt joists 12 shown in FIG. 15. In the depicted embodiment, the hollow tubular portion are made parallel to two side surface of the respective skirt joists 12 and the splice members 22 are planar. Other suitable dimensions of the tubular portions and corresponding splice members 22 can be used.

Figure 17:
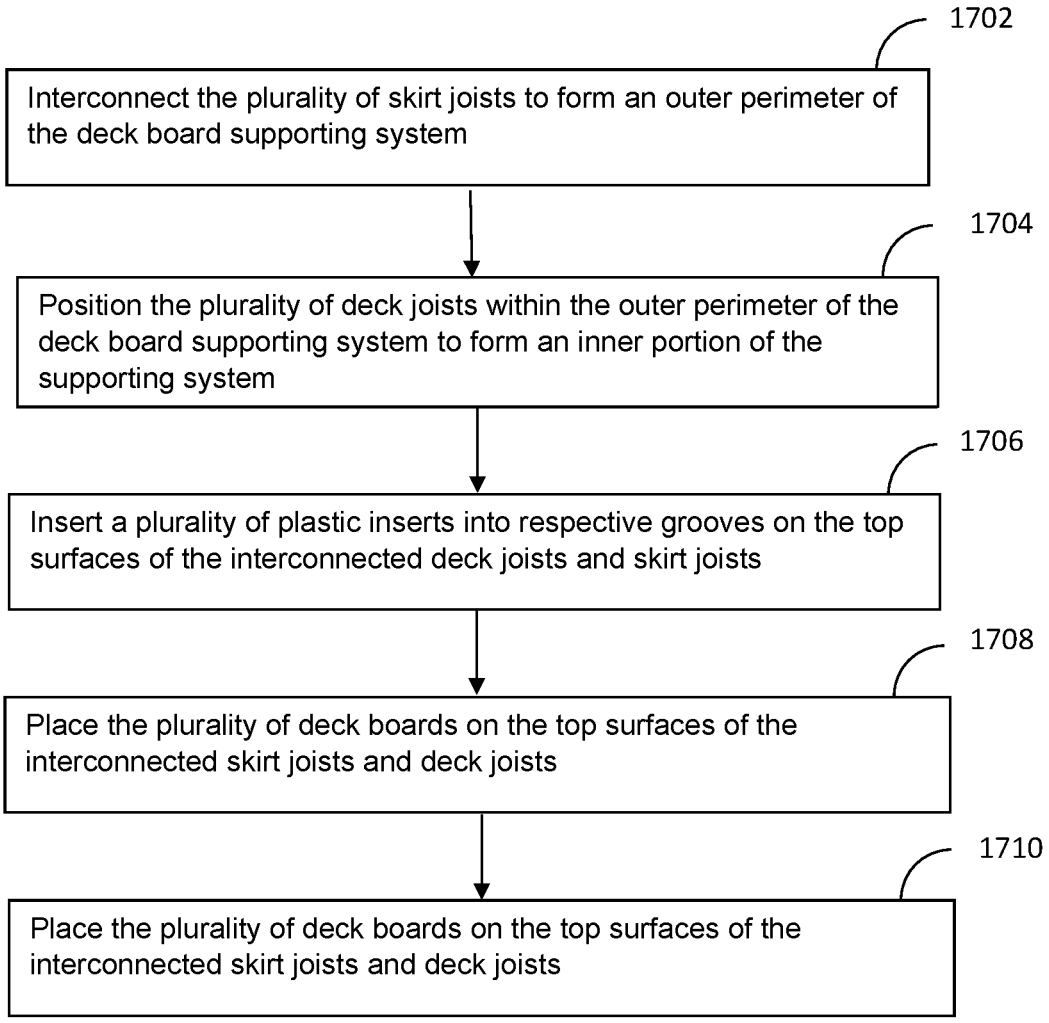
FIG. 17 is a flowchart illustrating a method of installing a deck system according to one embodiment of the present invention.

Referring to FIG. 17, a method of installing a deck system using a plurality of deck boards and a deck board supporting system includes, at step 1702, interconnecting the plurality of skirt joists to form an outer perimeter of the deck board supporting system. In one embodiment, each of the skirt joist (e.g., skirt joist 12) is an elongated rectangular member having a first end and a second end defining a length thereof, and each of the deck joist and skirt joist (e.g., deck joist 14) includes at least a hollow portion at the first end and the second end thereof. A plurality of splice members are positioned within the hollow tubular portion at the first and second ends of the corresponding skirt joists to span a desired length.

At step 1704, a plurality of deck joists are positioned within the outer perimeter of the deck board supporting system to form an inner portion of the supporting system. In one embodiment, each skirt joist (e.g., skirt joist 12) includes one or more ledges on an outer surface of the skirt joist configured to engage with a deck joist (e.g., deck joist 14) positioned perpendicular to a respective skirt joist. The height of the skirt joists are twice that of the deck joists. As such, two deck joist are stacked together perpendicularly to achieve a same height as that of a skirt joist 12. The decking boards 16 can thus be leveled on top of the supporting system 10. Alternatively, a plurality of cross member 50 are used to replace the lower deck joist 14. In this scenario, the plurality of cross members 50 are positioned between parallel skirt joists 12 of the outer perimeter and underneath and perpendicular to the plurality of deck joists 14, as shown in FIGS. 11-14.

At step 1706, a plurality of plastic inserts are inserted into respective grooves on the top surfaces of the interconnected deck joists and skirt joists. As an example, the plastic insert is depicted as a U-shaped plastic insert. The plastic insert 30 is preferably rendered from polyvinylchloride (PVC), but any suitable thermoplastic material such as polypropylene, polyethylene, high density polyethylene (HDPE), vinyl acetate copolymers, vinyl chloride monomers (VCM), or acrylonitrile-butadiene-styrene (ABS) can be used.

At step 1708, the plurality of deck boards are placed on the top surfaces of the interconnected skirt joists and deck joists. In the depicted embodiment shown in FIG. 1, the plurality of deck boards are positioned such that the length of each deck board extend across two adjacent parallel skirt joists and/or deck joists.

At step 1710, the plurality of deck boards are secured to on top surfaces of the interconnected skirt joists and deck joists via inserting one or more fasteners into plastic inserts in the longitudinal grooves on the top surfaces of the skirt joists and deck joists. For example, the one or more fasteners are one or more screws, nail, and the like. For example, when connecting a deck board (e.g., deck board 16) to a skirt joist (e.g., skirt joist 12), one or more fasteners 32 can be extended downward through deck boards into the insert (e.g., a U-shaped plastic insert) inside the groove (e.g., groove 28) on a skirt joist (e.g., skirt joist 12) and/or a deck joist (e.g., deck joist 14), thereby fixing the deck boards 16 to the respective skirt joist 12 and deck joist 14.

The deck system can be secured to a fixed support. For example, one or more of the plurality of deck joists can be further secured to a fixed support. The one or more vertical posts are secured to the one or more vertical posts situated on a base (e.g., base 20). This can further elevate the height of a deck system. As an example, the vertical post 18 can be made from a pressure treated wood or other polymer material that has high strength and is highly endurable. The base 20 can be cast in concrete and secured to an underlying surface (e.g., ground). The deck system can also be supported by flotation devices (e.g., flotation devices 70 shown in FIG. 1). The components of the deck system can be made of aluminum, polystyrene or other suitable materials.

The present deck system and method can be used in a floating dock and pier system. The deck system can be further supported by flotation devices and/or fixed supports (e.g., vertical posts). The plastic insert of the deck supporting system is designed to exert an appropriate grip force to the fastener being inserted. No pre-drilling of the metal joist is needed. Because the fasteners are isolated from the metal joists by plastic insert, the life expectancy of the fastener and the joists are greatly improved.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described.

What is claimed is:

1. A deck board supporting system comprising:

a plurality of interconnected skirt joists configured as an outer perimeter of the deck board supporting system;

a plurality of deck joists configured to be attached to one or more of the plurality of skirt joists within the outer perimeter;

each of the skirt joists and deck joists having a longitudinal groove formed on a respective top surface; and a plurality of plastic inserts configured to be fitted inside the respective longitudinal grooves and configured with an upper insert opening to receive one or more fasteners inserted therein through upper surfaces of one or more deck boards for connecting the one or more deck boards to the respective top surfaces of the skirt joists and the deck joists.

2. The deck board supporting system of claim 1, wherein each of the plastic inserts is made of polyvinylchloride (PVC).

3. The deck board supporting system of claim 1, wherein the one or more fasteners are one or more screws.

4. The deck board supporting system of claim 1, wherein one or more of the plurality of deck joists are supported by a vertical post situated on a base.

5. The deck board supporting system of claim 4, wherein the base is made of concrete and secured to an underlying surface.

6. The deck board supporting system of claim 1, wherein one or more of the plurality of deck joists are supported by a plurality of cross members, and wherein the plurality of cross members are secured to the outer perimeter of the deck board supporting system via respective L-shaped mounting brackets.

7. The deck board supporting system of claim 6, wherein the plurality of cross members are further supported by a flotation device.

8. The deck board supporting system of claim 1, wherein each of the skirt joists and the deck joists is an elongated rectangular member having a first end and a second end defining a length thereof, and each of the deck joists and the skirt joists includes a respective hollow tubular portion at each of the first end and the second end thereof, and wherein the supporting system further comprising a plurality of splice members sized and shaped to be received within the respective hollow tubular portions to span a desired length.

9. The deck board supporting system of claim 8, wherein the respective hollow tubular portions are each configured to be covered by a wall flange.

10. The deck board supporting system of claim 1, wherein the plurality of skirt joists and deck joists are made of aluminum or polystyrene.

11. The deck board supporting system of claim 1, wherein each of the skirt joists includes one or more ledges on an outer surface thereof configured to engage with a respective one of the deck joists positioned perpendicular to the skirt joists.

12. The deck board supporting system of claim 1, wherein a height of the skirt joists is twice that of the deck joists, such that two deck joists stacked together achieve a same height as that of the skirt joists.

13. The deck board supporting system of claim 1, further comprising a joist clip configured to connect two perpendicular positioned ones of the deck joists or skirt joists.

14. A method of installing of a deck system using a plurality of deck boards and a deck board supporting system, wherein the deck board supporting system includes a plurality of skirt joists, a plurality of deck joists, and each of the skirt joists and deck joists has a longitudinal groove formed on a respective top surface, and a plurality of plastic inserts configured to be snuggly fitted inside the respective longitudinal grooves on the top surfaces of the skirt joists and deck joists, the method comprising:

interconnecting the plurality of skirt joists to form an outer perimeter of the deck board supporting system;

positioning the plurality of deck joists within the outer perimeter of the deck board supporting system to form an inner portion of the supporting system;

inserting a plurality of plastic inserts into the respective longitudinal grooves;

placing the plurality of deck boards on the top surfaces of the interconnected skirt joists and deck joists; and securing the plurality of deck boards to the top surfaces of the interconnected skirt joists and deck joists via inserting one or more fasteners into the plastic inserts in the respective longitudinal grooves on the top surfaces of the skirt joists and deck joists.

15. The method of claim 14, further comprising securing one or more of the plurality of deck joists to one or more vertical posts and securing the one or more vertical posts on a concrete base.

16. The method of claim 14, wherein the one or more fasteners are screws.

17. The method of claim 14, wherein each of the skirt joists and deck joists is an elongated rectangular member having a first end and a second end defining a length thereof, and each of the deck joists and skirt joists includes at least a respective hollow tubular portion at each of the first end and the second end thereof; and wherein interconnecting the plurality of skirt joists to form an outer perimeter and positioning the plurality of deck joists within the outer perimeter of the deck board supporting system includes positioning a plurality of splice members within the respective hollow tubular portions to span a desired length.

18. The method of claim 14, wherein positioning the plurality of deck joists within the outer perimeter of the deck board supporting system to form an inner portion of the supporting system includes positioning one or more of the plurality of deck joists perpendicular to one or more of the plurality of skirt joists via one or more ledges formed on an outer surface of the respective skirt joists.

* * * * *